United States Patent [19]

Herrington

[11] Patent Number: 4,656,900

[45] Date of Patent: Apr. 14, 1987

[54] ROTARY TUBE PUNCHING ARRANGEMENT AND METHOD FOR PUNCHING HOLES INTO A MOVING WEB MATERIAL

[75] Inventor: Fox J. Herrington, Holcomb, N.Y.

[73] Assignee: Mobil Oil Corporation, New York, N.Y.

[21] Appl. No.: 798,518

[22] Filed: Nov. 15, 1985

[51] Int. Cl.[4] ..... B26D 7/18

[52] U.S. Cl. ..... 83/24; 83/37; 83/100; 83/345; 83/670

[58] Field of Search ..... 83/24, 37, 100, 345, 83/670, 98, 22

[56] References Cited

U.S. PATENT DOCUMENTS

| | | | |
|---|---|---|---|
| 1,579,182 | 3/1926 | Thayer | 83/345 X |
| 2,182,744 | 12/1939 | Ehrsam | 83/100 X |
| 2,302,855 | 11/1942 | Hallman | 83/100 X |
| 2,385,692 | 9/1945 | Corbin et al. | 83/345 X |
| 3,005,370 | 10/1961 | Nye | 83/345 |
| 3,174,428 | 3/1965 | Huck | 83/100 X |
| 3,194,095 | 7/1965 | Buck et al. | 83/345 X |
| 3,222,966 | 12/1965 | Tornberg et al. | 83/347 X |

FOREIGN PATENT DOCUMENTS

| | | | |
|---|---|---|---|
| 1235372 | 6/1971 | United Kingdom | 83/670 |

*Primary Examiner*—Frank T. Yost

*Attorney, Agent, or Firm*—Allexander J. McKillop; Michael G. Gilman; Charles J. Speciale

[57] ABSTRACT

A method of accurately punching holes into a moving web of a thermoplastic film material, and more particularly, punching holes into the web through the intermediary of a rotary serrated tube punch. The invention relates to accurately punching holes into an advancing web of thermoplastic film material utilizing a novel rotary serrated tube punch. The film web is continuously advanced over at least a portion of the circumferential surface of a rotatable anvil roll, and tensioned against the anvil roll surface through the use of suitable tensioning devices, such as tension rollers arranged upstream and downstream of the anvil roll. At least one opening is formed in the circumferential surface of the anvil roll which is slightly larger than the size of the hole which is desired to be punched into the film web through the use of the inventive rotary tube punching arrangement. The rotary tube punch possesses a serrated cutting edge at its radially outermost end, and is adapted to be rotated in synchronism with the anvil roll so as to cause the serrated cutting edge pierce through the web in a precisely aligned position with the opening in the rotating anvil roll, and to thereby produce an accurately dimensioned hole in the moving web without the necessity for stopping the web. The anvil roll may be constructed hollow, and communicates with a suctioning source for aspirating punched out film material segments.

14 Claims, 6 Drawing Figures

ROTARY TUBE PUNCHING ARRANGEMENT AND METHOD FOR PUNCHING HOLES INTO A MOVING WEB MATERIAL

BACKGROUND OF THE INVENTION

1. Field of the Invention

The present invention relates to a method of accurately punching holes into a moving web of a thermoplastic film material, and more particularly, punching holes into the web through the intermediary of a rotary serrated tube punch. Moreover, the invention also relates to accurately punching holes into an advancing web of thermoplastic film material utilizing a novel rotary serrated tube punch.

In the production of various types of articles which are basically formed from a thermoplastic film material, such as polyethylene film or the like; for instance, articles such as plastic bags employed in supermarkets or plastic garbage disposal or trash bags, it is frequently necessary to provide holes in a web of the thermoplastic film material employed for the high-speed series production of the bags, which must be punched through at a high degree of accuracy with respect to the location of the holes in the film web and repetitions in successive hole patterns. Thus, for instance, with regard to plastic bags onto which tapes are to be applied and which are used for closing trash bags in the manner of a drawstring, and into which there must be provided holes in order to afford a consumer access to the tape for closing the bags, the inability of presently employed production equipment in providing accurately positioned and dimensioned holes necessitates wider border edges to be formed on the film web for the receipt of such tapes, with the result of requiring greater amounts of plastic material in the formation of the bags thereby rendering current manufacturing methods less than optionally economical.

Thus, a need has arisen in industry for methods and apparatus for accurately punching holes of various sizes and configurations through webs of thermoplastic film material, in which the webs are conveyed in a continuous mode between processing stations so as to afford optimized production rates and extremely high degrees of manufacturing accuracy, without the need to stop the continual advance of the film web during the hole punching procedure.

Heretofore, one particular method of punching holes through polyethylene film webs contemplated the use of hole punching apparatus incorporating a tube forming a die punch having a cutting edge consisting of serrations or sharpened teeth facing towards the film. For example, a punching apparatus of that type is disclosed in Adams, et al. U.S. Pat. No. 3,580,120. The serrated cutting edge of the punch is then pressed through the film web while the latter is in a stationary condition during the intermittent advance of the web and with the web being supported externally of the die punch in order to maintain the necessary tension on the film web. Thus, in order to employ a serrated punch for punching holes into a film web, it is necessary to either advance the web only intermittently in order to prevent it from moving while the hole is being punched, or to reciprocate the punch so as to match the web speed when the latter is continually advanced, or to press the punch through the moving web and, as a result, produce a relatively ragged and inaccurate hole. Consequently, the prior art hole punching methods and apparatus are either complex in construction and/or cumbersome in use, and fail to provide the required accuracy in forming punched holes in a continuously advancing web of thermoplastic film material.

2. Discussion of the Prior Art

Although rotary film web or sheet material punching devices are known in the technology, none of these devices are analogous to the arrangement pursuant to the present invention and to implementing the hole punching method as disclosed herein.

Stoop U.S. Pat. No. 3,680,419 discloses a rotary punch device in which a hollow rotating punch has a projecting cutting edge which is adapted to cut holes into a paper web advanced over an anvil roll, and wherein the chips which are punched out of the paper web aspirated through the punch by a vacuum. This prior art device, however, fails to provide for tensioning a thermoplastic film web about the circumference of an anvil roll and the punching of holes therethrough by a serrated cutting edge on a punch analogous to that of the present invention, and thus would not be capable of providing the desired degree of accuracy in the punching of holes into a continuously advancing web of a thermoplastic film material.

Leroy U.S. Pat. No. 4,480,516 discloses a rotatable cutting device contacting an anvil or counter roll over which a film web is advanced by means of a cutter possessing a cutting edge for severing the web into predetermined sections. This does not allow for the formation of holes in an accurate manner analogous to that afforded by the device and method pursuant to the present device.

Finally, Helm U.S. Pat. No. 3,728,918 discloses a rotary panel cutter through the intermediary of which sections are cut out of a continuously advanced film web. However, there is no disclosure of a serrated cutter engaging into an opening in an anvil roll to punch accurately-sized holes into a film web analogous to that of the present invention.

SUMMARY OF THE INVENTION

In essence, the present invention provides for a rotary serrated tube punching arrangement, in which a film web of a thermoplastic material is continuously advanced over at least a portion of the circumferential surface of a rotatable anvil roll which, if desired, may be hollow, and tensioned against the anvil roll surface through the use of suitable tensioning devices, such as tension rollers arranged upstream and downstream of the anvil roll. At least one opening is formed in the circumferential surface of the anvil roll which is slightly larger in size than the size of the hole which is desired to be punched into the film web through the use of the inventive rotary tube punching arrangement. A rotatable rotary tube punch possessing a serrated cutting edge at its radially outermost end, is adapted to be rotated in synchronism with the anvil roll so as to cause the serrated cutting edge pierce through the web in a precisely aligned position with the opening in the rotating anvil roll, and to thereby produce an accurately dimensioned hole in the moving web without the necessity for stopping the web.

Furthermore, the speeds of rotation and diameters of the anvil roll and of the rotating punch may be correlated with respect to each other, wherein the circumference of the anvil roll about which the film web is transported is essentially equal to the repeat length of the hole locations which are to be punched through the film web, or equal to an integral fraction or multiple thereof. The serrated cutting edge of the punch, the latter of which may be mounted on a rotatable disc or on the end of an arm journaled on a rotating shaft, rotates at a speed such that the cutting edge of the punch travels at the same linear speed of advance as the speed of the hole in the circumference of the anvil roll. The hole in the anvil roll is slightly larger than the size of the serrated cutting edge of the punch, with the surface of the anvil roll surrounding the hole supporting the film web, and thereby facilitating the accurate punching through of the film web by the cutting edge of the punch as the latter enters the hole in the anvil roll.

Pursuant to another aspect of the present invention, the serrated cutting edge on the punch and the hole in the anvil roll need not be necessary round in shape, but may be configured to punch holes in the film web which are of various shapes; such as, for example, elliptical, oval or even olygonally-shaped holes possessing accurate dimensions.

Accordingly, it is an object of the present invention to provide a unique rotary punching arrangement incorporating a rotary serrated tube punch engaging into a slightly larger opening provided in a rotatable anvil roll over the circumference of which there is tensioned a continuously advancing web of thermoplastic film material in order punch accurately-sized holes into the web without any distortion of the holes or the web material.

A more specific object resides in the provision of a rotary serrated tube punch which is rotated in synchronism with an anvil roll over which a thermoplastic film web is tensioned for forming accurately-sized and spaced holes in the film web.

Pursuant to another aspect of the invention, aspirating means is in communication with the interior of the anvil roll, the latter of which is of a hollow drum construction, for suctioning out the segments of the thermoplastic film web punched out by the serrated punch, and conveying the segments to waste receiving or disposal means.

In accordance with still another object of the present invention, it is an object to provide a novel method for accurately punching holes into a continuously advancing thermoplastic film web utilizing the unique rotary serrated tube punch and anvil roll arrangements as described herein.

BRIEF DESCRIPTION OF THE DRAWINGS

Reference may now be had to the following detailed description of exemplary embodiments of the rotary tube punching arrangement, taken in conjunction with the accompanying drawings; in which.

DETAILED DESCRIPTION

Figure 1:
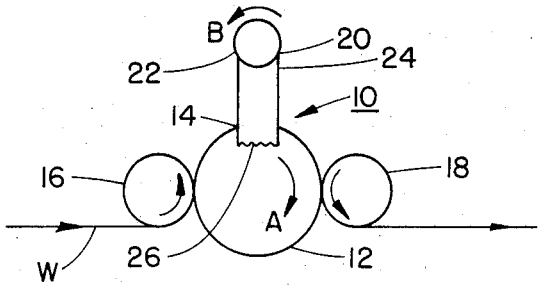
FIG. 1 illustrates a schematic representation of an apparatus for punching holes in a continuously advancing film of a thermoplastic film web material.

Referring to FIG. 1 of the drawings, there is schematically illustrated a rotary die punching arrangement 10 for punching holes into a continuously advancing web W of a thermoplastic film material, for example, such as polyethylene film which is utilized in the production of plastic bags, trash disposal bags or the like. The die punching arrangement 10 basically incorporates an anvil roll 12, which in this embodiment is preferably but not necessarily of a hollow drum-like construction, and which has a punch-receiving opening 14 formed in its circumferential surface. A pair of freely-rotatable tension rollers 16 and 18 are positioned respectively one each upstream and downstream of the anvil roll 12, preferably in surface contact therewith, along which there is conducted the film web W such that the rollers 16, 18 form tensioning guides for the web W as the web is being conducted over the circumferential surface of the anvil roll 12, to maintain the film thereon in a predetermined tensioned condition. The anvil roll 12 is rotated through a suitable drive in the direction of arrow A, while concurrently therewith a die punch arrangement 20 is rotated in the counter-rotatable direction of arrow B in predetermined synchronism therewith. The die punch arrangement 20 includes a rotatable shaft member 22 which may be driven in synchronism therewith with the anvil roll 12 by being either geared or belted therewith, as detailed in connection with FIGS. 2 to 6, and incorporates a radially extending tubular die punch 24 which, at its free end, has a serrated cutting edge 26 adapted to project into the punch-receiving opening 14 in the circumference of the anvil roll so as to cause the die punch 24 to punch a hole into the film web W.

The tensioning of the film web W by the tensioning rollers 16, 18 will ensure that the hole which is punched therein by the rotatable punch 24 is accurately dimensioned and not distorted by any shifting of the film web on the anvil roll surface as it is being punched.

Figure 2:
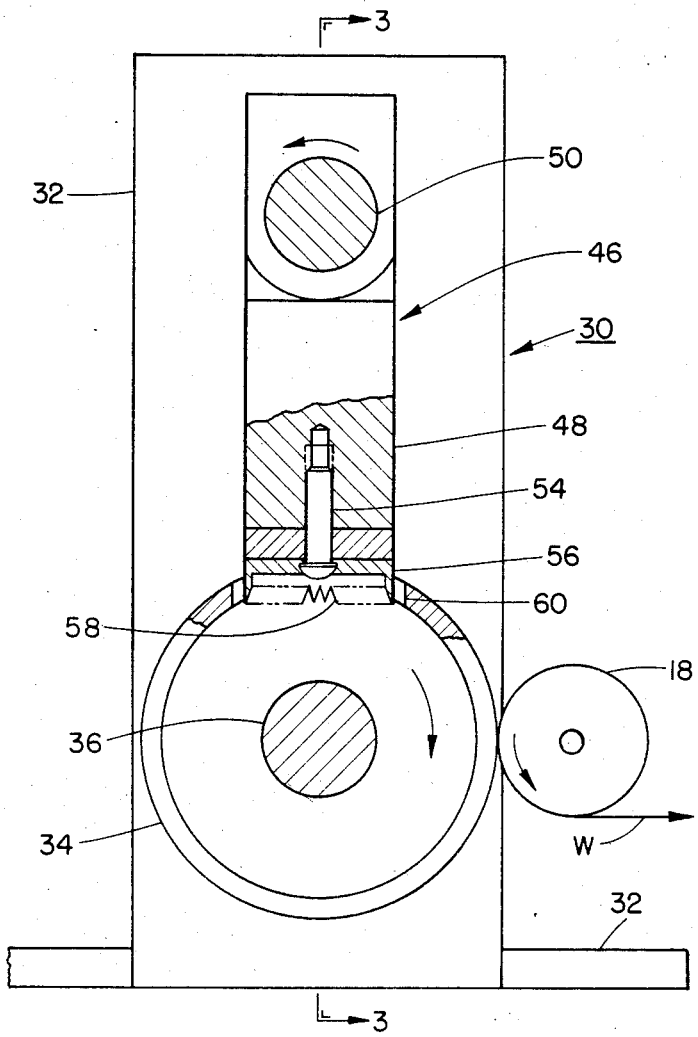
FIG. 2 illustrates, partly in section, a side elevational view of an apparatus for punching holes in a continuously advancing web of a thermoplastic film material.
Figure 3:
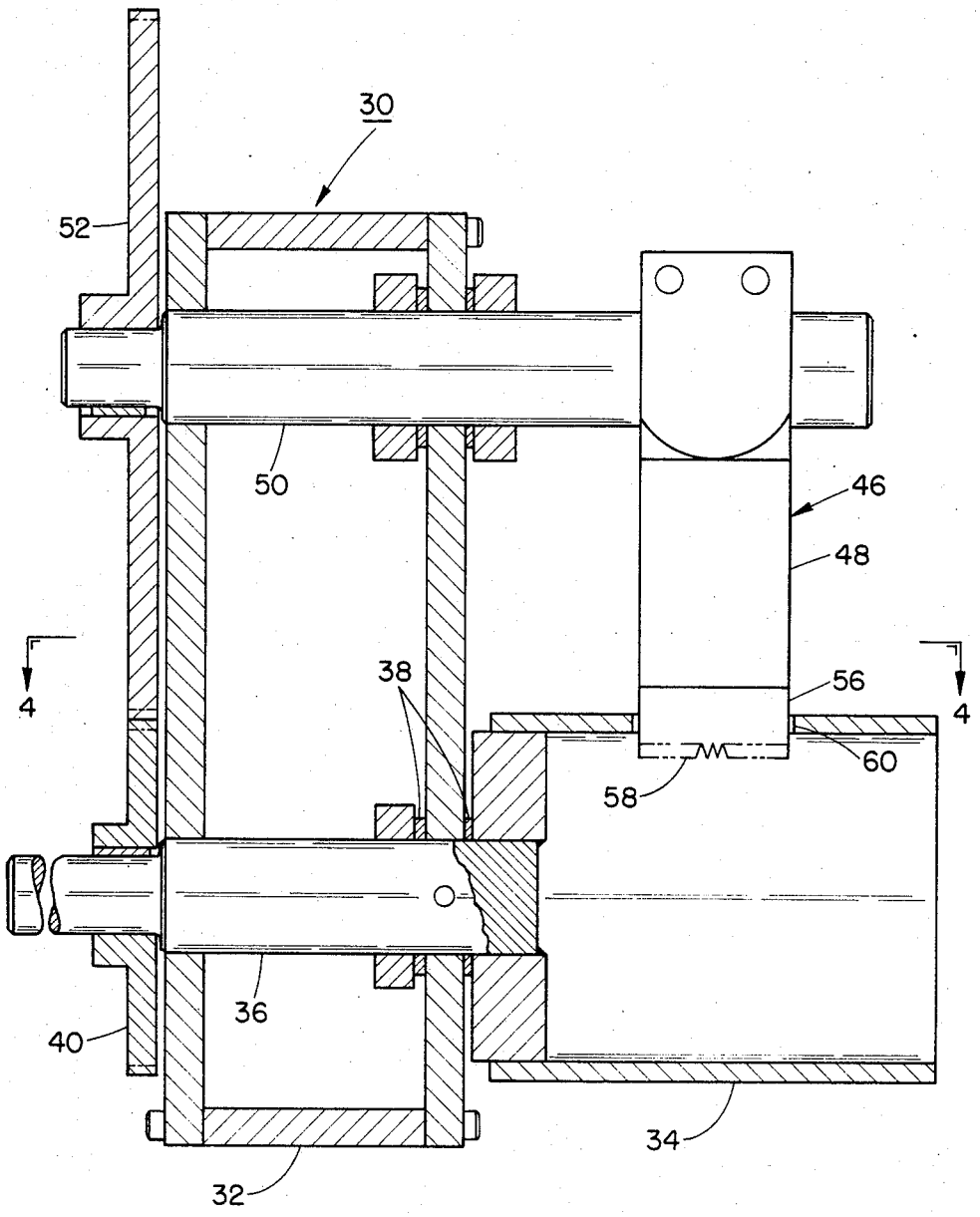
FIG. 3 illustrates a sectional view of the apparatus taken along line 3—3 in FIG. 2.
Figure 4:
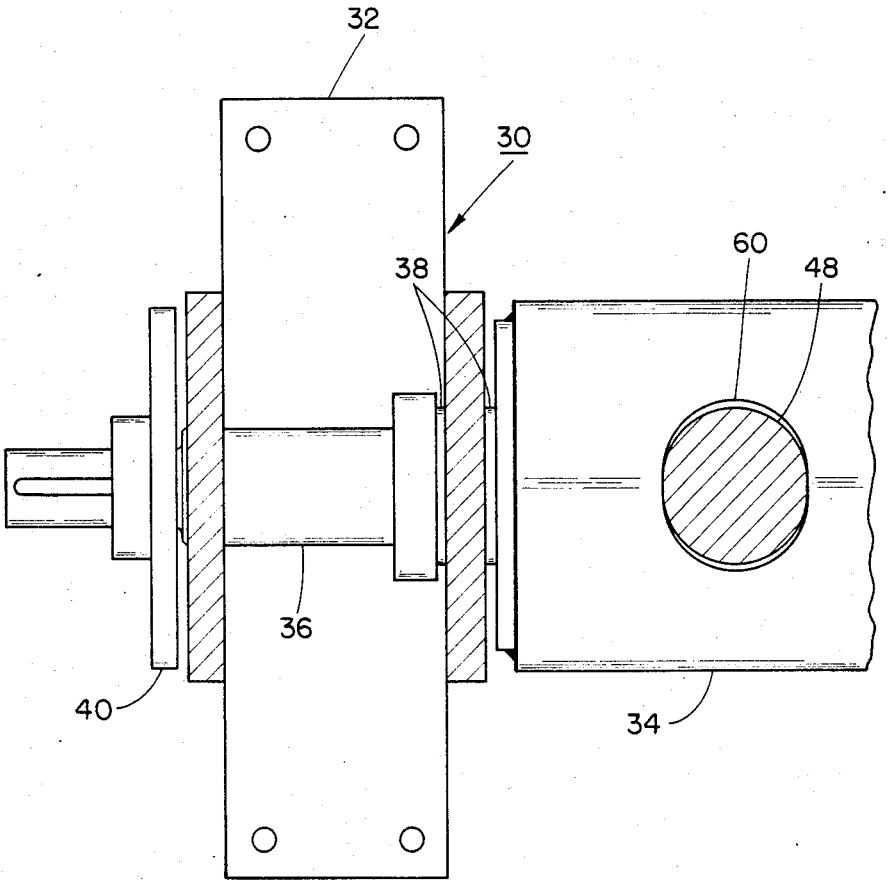
FIG. 4 illustrates a sectional view taken along line 4—4 in FIG. 3.

Referring to the particular embodiment of a rotary die punching arrangement 30 disclosed in FIGS. 2 through 4 of the drawings, rotatably supported from a stationary frame structure 32 is a hollow anvil roll 34, which may be a closed-ended drum constituted of a suitable metal, such as steel or the like. Projecting coaxially from one end of the anvil roll 34 is a shaft 36 which is fixed thereto, which is rotatably journaled in suitable bearings 38 provided in the stationary frame structure 32, and which shaft mounts a spur gear 40 at its free end 42. The circumferential surface of the anvil roll 34 is provided with at least one through opening of predetermined size for receiving a die punch cutter. A rotary punching device 46 consists of an arm member 48 which, at one end thereof, is fixedly clamped to a rotatable shaft 50 which is journaled in the frame structure 32, and which extends in parallel spaced relationship with the shaft 36. A spur gear 52 fastened to the other end of the shaft 50 is in driving interengagement with the spur gear 40 such that both shafts 36, 50 may be counter-rotated in predetermined synchronism by a suitable driving arrangement (not shown).

Fastened to the opposite free end of the arm member 48 of the punching device 46, such as by a screw fastening 54, is an annular, or sleeve-like cutter 56 having a serrated or toothed cutting edge 58 facing towards the circumferential surface of the anvil roll 34.

The relative rotational movement between the arm member 48 that and of the anvil roll 34 is correlated and synchronized, for example, by the ratio of the pitch diameters of the interengaged gears 40, 52; the radius of rotation of the cutter 56 about its shaft 50, and the diameter of the anvil roll 34. This then will ensure that the cutting edge 58 will enter the opening 60 formed in the circumferential surface of the anvil roll 34 in an aligned, accurate manner at predetermined intervals of rotation of the anvil drum.

Thus, for example, in producing bags from the plastic film web W which have a repeat length of 30 inches, the anvil roll 34 has a circumferential length of 15 inches. The cutting edge 58 of the cutter 56 has a radius of rotation of about 5 inches about its shaft 52, such that the rotary punching device 46 makes one revolution for every two revolutions of the anvil roll 34. As drawn more clearly in FIG. 4, the cutter 56 is about 2 inches in diameter, whereas the opening 60 in the anvil roll is about $2\frac{1}{8}$ inches in diameter, with the cutter imbedding about 9/16 inch into the opening 60 when piercing through the film web W.

The holes need not be necessarily round, but may be oval or elliptical as shown in FIG. 4 of the drawings, and the arrangement is also adapted to punch accurately-sized holes in the film web W possessing different configurations.

Figure 5:
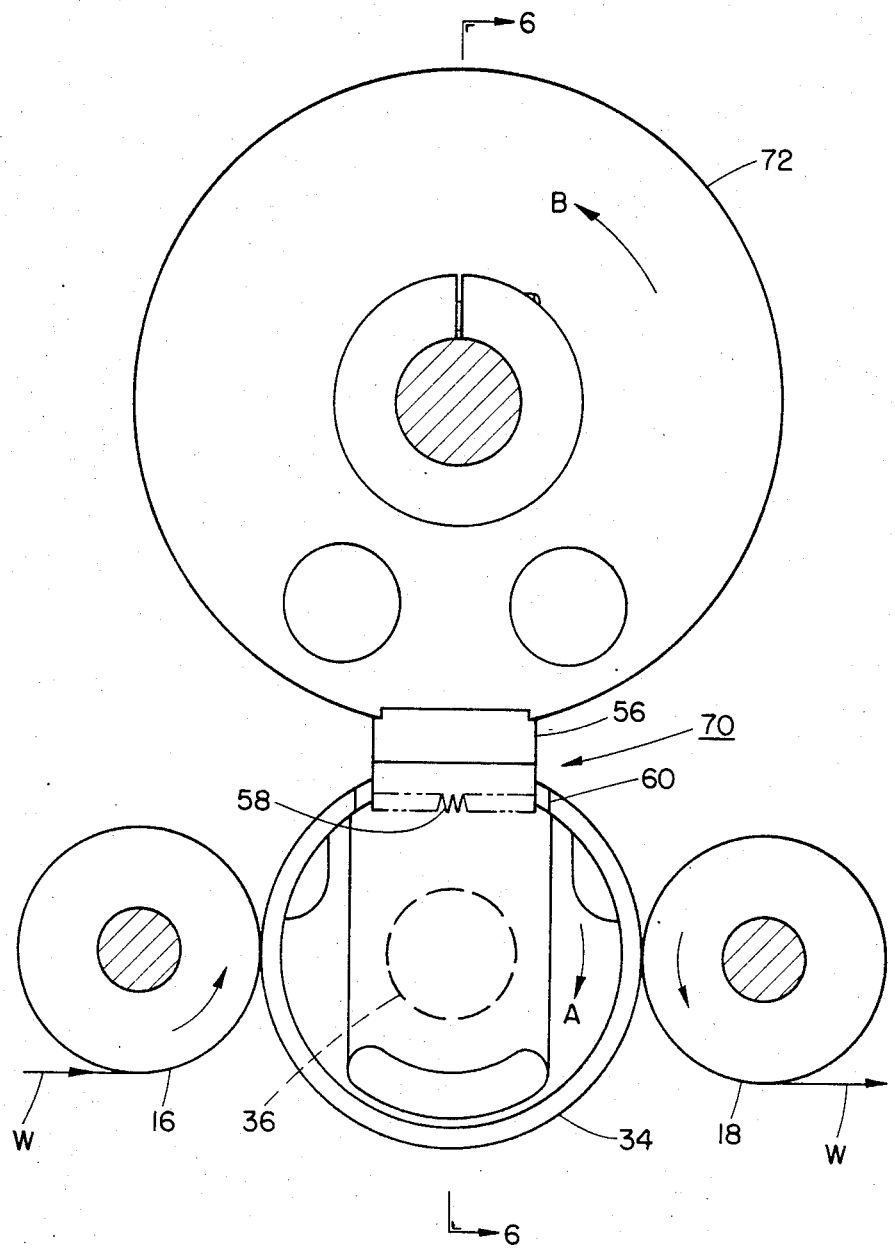
FIG. 5 illustrates an elevational view of a modified embodiment of the apparatus.
Figure 6:
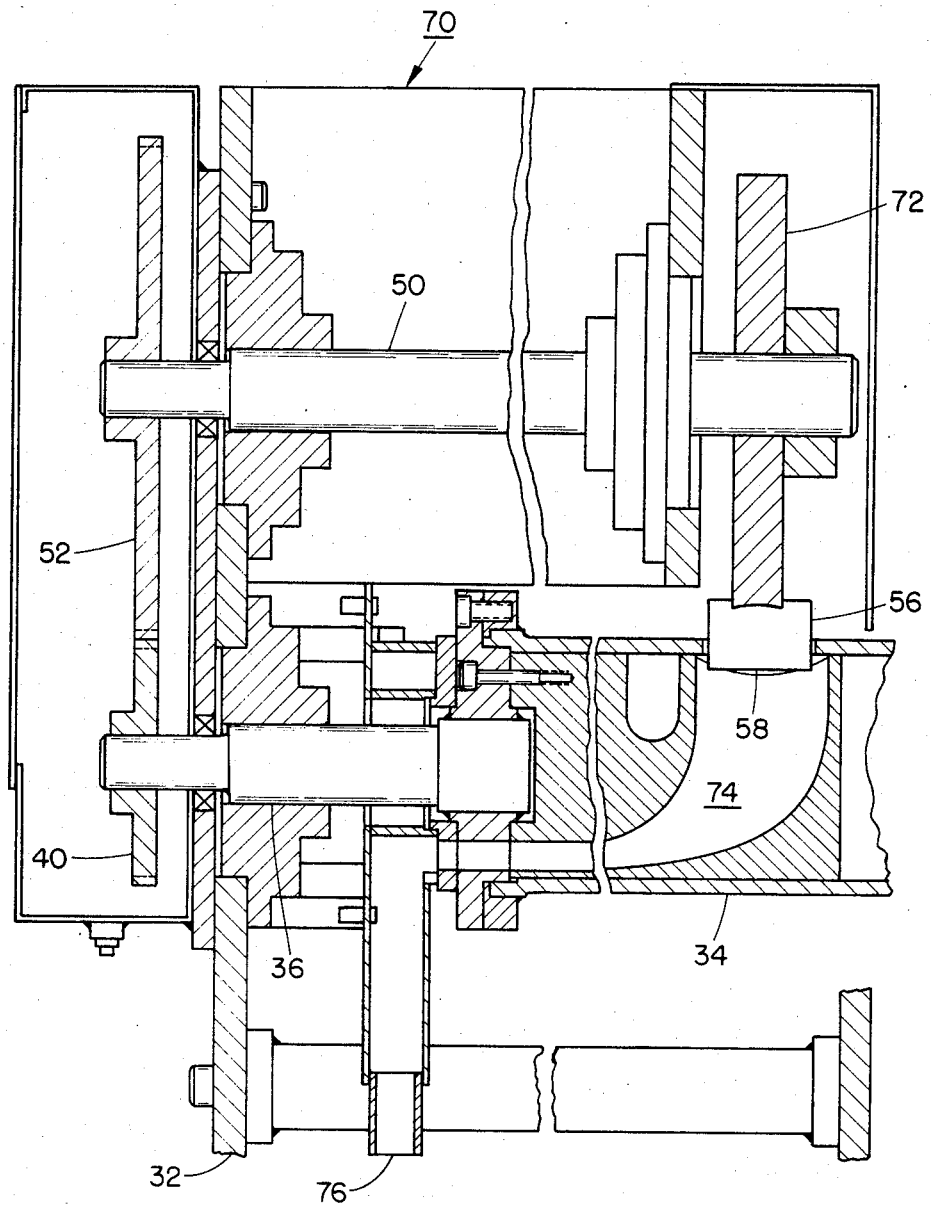
FIG. 6 illustrates, in a reduced scale, a sectional view taken along line 6—6 in FIG. 5.

In the modified embodiment of the rotary die punching arrangement 70 of the invention pursuant to FIGS. 5 and 6, in which components which are similar to or identical with those in the embodiment of FIGS. 2 to 4 are designated by the same reference numerals, the cutter 56 and its serrated cutting edge 58 are mounted on a rotatable disc member 72 which is fastened to the rotatable shaft 52, in lieu of being mounted on an arm member 48.

In this embodiment, the interior of the anvil roll 34 incorporates a passageway 74 which is in communication with the opening 60 and a suctioning device (not shown) for aspirating the punched-out portions of the film web W into the passageway 74, and then discharging them through an outlet 76 for further processing or to a waste disposal.

From the foregoing, it clearly appears that the invention is directed to an extremely simple rotary die punching arrangement for accurately punching holes through a continuously advancing film of a thermoplastic web material, wherein the holes in the web may be spaced as required depending upon the proportional diameters and speeds of rotation of the anvil roll and the rotary die punch, while concurrently permitting the punching of holes of configurations which are other than round into the web.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A rotary die punching arrangement for punching holes into a continuously advancing thermoplastic film web, comprising:

(a) a rotatable anvil roll constituted of a closed-ended hollow cylindrical drum having said film web extending in surface contact with at least a portion of the circumference of said roll; at least one punch-receiving opening of predetermined size being formed in the circumferential surface of said hollow drum at a predetermined location and having said film web advancing thereover, said opening extending through the wall of said drum so as to communicate with the hollow interior of said drum;

(b) a rotary punch having a serrated cutting edge at the radially outer end thereof adapted to pierce said web and to enter said opening in said anvil roll at predetermined intervals;

(c) means for rotating said rotary punch; and means for imparting rotation to said anvil roll;

(d) means for synchronizing the rotational movements of said anvil roll and said rotary punch said film web advancing over said opening on the anvil roll facing said punch whereby said serrated cutting edge punches a hole into said web upon entering said opening in said anvil roll;

(e) and suctioning means communicating with the interior of said hollow drum for aspirating thee segments of said film web punched out by said rotary punch.

2. An arrangement as claimed in claimed in claim 1, wherein said opening in said anvil roll is slightly larger than the diameter of said punch.

3. An arrangement as claimed in claim 1, comprising a stationary frame structure, said means for rotating said rotary punch being a first shaft rotatably journaled on said frame structure; said means for rotating said anvil roll being a second shaft rotatably journaled on said frame structure; and said means for synchronizing the rotational movements of said rotary punch and said anvil roll including means operatively interconnecting said first and second shafts.

4. An arrangement as claimed in claim 3, wherein said means operatively interconnecting said first and second shaft comprises interengaged driving gears fsatened to the ends of said shafts for rotating said shafts at predetermined counter-rotating speed ratios.

5. An arrangement as claimed in claim 1, comprising means for tensioning said film web during the advance of said web along the circumferential surface of said anvil roll.

6. An arrangement as claimed in claim 5, wherein said film web tensioning means comprise first and second freely-rotatable tensioning rollers, one said tensioning roller being positioned upstream of said anvil roll and the other said tensioning roller being positioned at the downstream side of said anvil roll, said film web being entrained over said tensioning rollers during advance thereof.

7. An arrangement as claimed in claim 6, wherein the circumferences of said tensioning rollers are in surface-contact with said anvil roll.

8. A method for punching holes into a continuously advancing thermoplstic film web, comprising:

(a) advancing said film web over a rotatable anvil roll constituted of a closed-ended hollow drum with said film web extending in surface contact with least a portion of the circumference of said roll; at least one punch-receiving opening of predetermined size extending through the circumferential surface of said anvil roll so as to communicate with the interior of said hollow drum;

(b) causing a rotary punch having a serrated cutting edge at the radially outer end thereof to pierce said film web and to enter said opening in said anvil roll at predetermined intervals;

(c) rotating said rotary punch; and concurrently rotating said anvil roll;

(d) and synchronizing the rotational movements of said anvil roll and said rotary punch said film web advancing over said opening on the anvil roll facing said punch to cause said serrated cutting edge to punch a hole into said web upon entering said opening said anvil roll;

(e) and suctioning the interior of said hollow drum for aspirating the segments of said film web punched out by said rotary punch.

9. A method as claimed in claim 8, wherein said opening in said anvil roll is slightly larger than the diameter of said punch.

10. A method as claimed in claim 8, comprising rotating said rotary punch with a first shaft rotatably journaled on a stationary frame structure; rotating said anvil roll with a second shaft rotatably journaled on said frame structure; and synchronizing the rotational movements of said rotary punch and said anvil roll by operatively interconnecting said first and second shafts.

11. A method as claimed in claim 10, comprising operatively interconnecting said first and second shafts by interengaged driving gears fastened to the ends of said shafts for rotating said shafts at predetermined counter-rotating speed ratios.

12. A method as claimed in claim 8, comprising tensioning said film web during the advance of said web along the circumferential surface of said anvil roll.

13. A method as claimed in claim 12, comprising tensioning said film web over first and second freely-rotatable tensioning rollers, one said tensioning roller being positioned upstream of said anvil roll and the other said tensioning roller being positioned at the downstream side of said anvil roll, and entraining said film web over said tensioning rollers during advance thereof.

14. A method as claimed in claim 13, comprising positioning said tensioning rollers in surface-contact with said anvil roll.

* * * * *